United States Patent [19]

Botes

[11] Patent Number: 5,020,769

[45] Date of Patent: Jun. 4, 1991

[54] SHUTTERING FOR USE IN BUILDING CONSTRUCTION

[76] Inventor: Hendrik P. Botes, Plot 27, Estate Road, Benoni Small Farms, Benoni, Transvaal Province, South Africa

[21] Appl. No.: 366,438

[22] Filed: Jun. 15, 1989

[51] Int. Cl.[5] ..... E04G 9/05; E04G 11/08; E04G 17/07

[52] U.S. Cl. ..... 249/44; 249/46; 249/47; 249/134; 249/190; 249/192

[58] Field of Search ..... 249/44, 45, 46, 47, 249/6, 191, 192, 134, 189, 34, 193, 218, 18, 26, 219.1, 219.2

[56] References Cited

U.S. PATENT DOCUMENTS

| | | | |
|---|---|---|---|
| 2,845,685 | 8/1958 | Lovgren et al. | 249/192 |
| 3,171,185 | 3/1965 | Anderson | 249/47 |
| 3,291,437 | 12/1966 | Bowden et al. | 259/192 |
| 3,327,986 | 6/1967 | Oury | 249/191 |
| 3,429,547 | 2/1969 | Schimmel | 249/47 |
| 3,488,027 | 1/1970 | Evans | 249/134 |
| 3,664,630 | 5/1972 | Maynen et al. | 249/47 |
| 3,682,436 | 8/1972 | Boenig | 249/134 |
| 4,044,986 | 8/1977 | Strickland et al. | 249/219.1 |
| 4,079,910 | 3/1978 | Miller | 249/44 |
| 4,181,286 | 1/1980 | Van Doren | 249/134 |
| 4,712,764 | 12/1987 | White | 249/134 |

FOREIGN PATENT DOCUMENTS

| | | | |
|---|---|---|---|
| 2349601 | 4/1975 | Fed. Rep. of Germany | 249/40 |
| 987011 | 8/1951 | France | 249/417 |
| 280018 | 11/1927 | United Kingdom | 249/192 |

*Primary Examiner*—Jay H. Woo
*Assistant Examiner*—Khanh P. Nguyen
*Attorney, Agent, or Firm*—St. Onge Steward Johnston & Reens

[57] ABSTRACT

The invention relates to shuttering elements for use in building construction. The shuttering elements are of a synthetic plastics material and define a rectangular shuttering wall, peripheral side walls and engagement and locking formations whereby a plurality of similar shuttering elements can engage one another and be locked in their engaged configuration, to form an extended shuttering wall of a shuttering structure. A complete shuttering structure defining a building structure to be constructed can then be erected by placing engaged shuttering elements in an opposing configuration, link rods providing for opposing walls of the shuttering structure to be engaged. A shuttering structure so formed can then be filled with a settable material in order to form the required building structure.

7 Claims, 3 Drawing Sheets

SHUTTERING FOR USE IN BUILDING CONSTRUCTION

BACKGROUND OF THE INVENTION

1. Field of the Invention

This invention relates to building construction. More particularly, the invention relates to shuttering elements for use in building construction and to a method of building construction.

2. Summary of the Invention

According to the invention there is provided a shuttering element which is of a synthetic plastics material and which comprises a rectangular planar shuttering wall and peripheral side walls projecting in one direction from the opposite side edges of the shuttering wall, engagement and locking formations being defined by the shuttering element along the respective sides thereof for permitting engagement and releasable locking of similar shuttering elements to one another into an operative configuration in which their shuttering walls form an extended continuous planar shuttering surface.

The shuttering element may define locating formations for receiving and locating a link rod whereby opposing shuttering elements, in an operative configuration of a shuttering structure, can be linked together in a desired spaced apart configuration. More particularly, locating formations may be defined at a location along at least one side edge of the shuttering element and, preferably, locating formations may be defined at locations along two or more side edges of the shuttering element. The locating formations of adjacent similar shuttering elements, in their operative configuration, can co-operate to locate a link rod with respect thereto. More particularly, the locating formations may be formed to locate a rod element of a link rod and engage a removable head formation, engageable with the rod element, for locating the link rod with respect to two adjacent similar shuttering elements.

According to a preferred embodiment of the shuttering element of the invention, the shuttering wall of the shuttering element may be substantially square. Still further, the shuttering element may include at least one reinforcing formation for reinforcing the planar configuration of its shuttering wall and the required configuration of the side walls with respect thereto. More particularly, the shuttering element may include a lattice of reinforcing ribs extending between the side walls of the shuttering element.

The side walls of the shuttering element may preferably project perpendicularly from the shuttering wall.

The shuttering element may clearly be of any suitable dimensions and preferably, the outer dimensions of the shuttering wall may be between 200mm×200mm and 600mm×600mm. Typically the said outer dimensions may be approximately 300mm×300mm. Still further, the width of the side walls of the shuttering element may typically be approximately 30mm, whereas the thickness of the respective walls of the shuttering element may be between 2mm and 10mm. The said side wall width dimension and wall thickness dimension may particularly be determined by the strength requirements of the shuttering element.

The shuttering element may further be of a synthetic plastics material known in the trade as ABS and, preferably, may be an integrally formed injection moulded element of the above or any other suitable synthetic plastics material, nylon also being considered particularly suitable.

According to a preferred embodiment of the invention, the shuttering element may include separate engagement and locking formations for permitting engagement and releasable locking of similar shuttering elements to one another. As such, the engagement formations may include profiled tongue formations projecting from the sides of the shuttering element and, complementary receiving formations defined on the sides of the shuttering element, the said formations being disposed to permit secure engagement of similar shuttering elements with one another and to hold together the shuttering walls of the shuttering elements in an abutting adjacent configuration.

Also, the locking formations may then comprise clipping formations, whereby engaged shuttering elements can be releasably locked in their engaged configuration. The clipping formations may be formed so that they can effectively resist the required displacement of engaged shuttering elements that will permit the tongue formations to disengage complementary receiving formations, thereby releasably locking engaged shuttering elements to one another.

The shuttering element of the invention may be modular and may be adapted to co-operate with other similar shuttering elements of different modular sizes.

The invention extends also to a link rod which is specifically adapted for use with shuttering elements in accordance with the present invention, a typical link rod comprising an elongate rod element that can extend across a space defined between opposing shuttering elements, and two removable head formations removably engageable with the rod element, near opposite ends thereof, that can engage formations defined by the shuttering elements on the operative outer sides thereof for securing the spacing between the shuttering elements. According to one embodiment, the elongage rod element may define a circular cross-sectional profile and peripheral grooves near opposite ends thereof, and the head formations are flat formations having keyhole apertures therein that permit engagement with the peripheral grooves and rotation of the head formations when so engaged, for the engagement with the shuttering elements. The link rod may also be of a synthetic plastics material such as ABS, nylon, or the like.

According to a further aspect of the invention there is provided a shuttering system which includes shuttering elements and link rods in accordance with the present invention, the shuttering elements permitting the construction of a part of or the complete shuttering for a building construction to be constructed and the link rods securing the spacing between opposing shuttering elements.

The shuttering system may further include special purpose shuttering members adapted and formed to co-operate with the shuttering elements to facilitate the internal and external corner construction of shuttering, wall end construction of shuttering, the provision of openings in walls, and the like.

Still a further aspect of the invention provides for a method of building construction which includes forming a complete shuttering structure whereby the walls of a building construction are defined, utilising shuttering elements and link rods in accordance with the present invention; and filling a settable material into the shuttering structure and allowing the settable material to set and cure and thereby form the walls of the required building construction.

The method of the invention may particularly include pre-forming entire wall sections of a shuttering structure to be constructed and erecting the wall sections on site.

Also, the method may include utilising special purpose shuttering members that can provide for special wall formations of a building construction to be constructed.

The method of the invention may preferably include first forming the operative inner walls of a shuttering structure and thereafter forming the outer walls of the shuttering structure and then linking inner walls to each other and then to the outer walls of the structure.

The method of the invention may still further include locating suitable reinforcing for a settable material within spaces defined between opposing shuttering elements of a shuttering structure. The reinforcing may typically comprise wire mesh.

The method of the invention may also include filling the settable material gradually into the shuttering structure so that the complete structure is evenly filled. Also, the shuttering structure may be subjected to vibration during and after pouring of the settable material to thereby eliminate air pockets.

Still further, the method may include that, after initial setting of the settable material, the link rods acting between the inner and outer walls of the shuttering structure are first removed and thereafter the walls of the shuttering structure.

The method of the invention may particularly include utilising concrete, mortar, aerated concrete with or without a chemical additive, or the like, as a settable material for forming the walls or other formations of a building construction. Although the shuttering element of the invention and the method of building as above defined essentially provide for the construction of buildings in the form of domestic homes, other domestic structures, and the like, the shuttering elements can clearly also be utilised for any other building structures or general structures that can be formed through the use of the shuttering elements. Many different special purpose elements and members than can co-operate with the shuttering elements of the invention can clearly also be designed and utilised for different applications of the shuttering elements.

BRIEF DESCRIPTION OF THE DRAWINGS

The invention is now described, by way of an example, with reference to the accompanying diagrammatic drawings, in which.

DESCRIPTION OF THE PREFERRED EMBODIMENT

Figure 7:
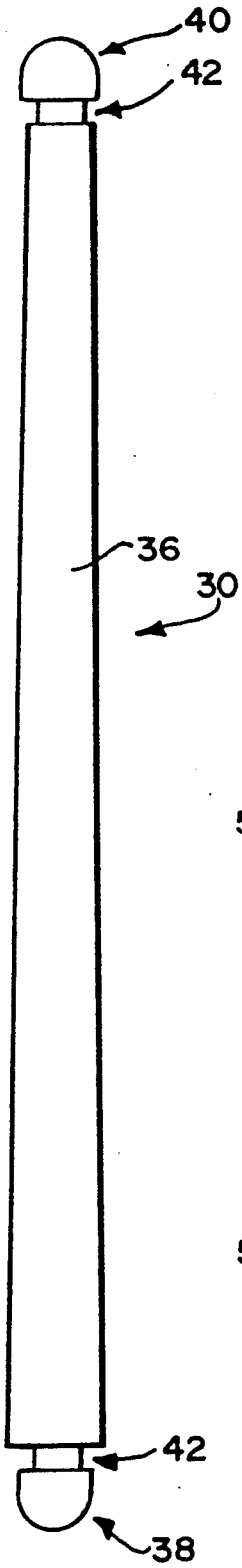
FIG. 7 shows an elevational view of the rod element of a link rod for use with the shuttering element of FIG. 1.

Referring initially to FIGS. 1 to 6 of the drawings, a shuttering element, in accordance with the invention, is generally indicated by the reference numeral 10. The shuttering element comprises an integrally moulded synthetic plastics preferably of ABS or nylon, and comprises a square planar shuttering wall 12 that is surrounded by peripheral side walls 14 all projecting in the same direction from the shuttering wall 12. The operative front side of the shuttering element 10 and, as such, the shuttering wall 12, defines a planar shuttering surface 16 with the operative rear side of the shuttering element 10 defining a hollow configuration. A lattice of reinforcing ribs 18 (only shown in dotted lines in FIG. 1) extend between opposing side walls 14 of the shuttering element 10 and acts to reinforce the planar structure of the shuttering wall 12 as well as the angular configuration between the shuttering wall 12 and the surrounding side walls 14.

The shuttering wall 12 of the shuttering element 10 is typically 300mm×300mm, with the material thickness varying between 2mm and 10mm, depending on the strength requirements of the shuttering element. The thickness of the shuttering element, i.e. the width of the side walls, is typically 30mm, although this is again determined by the strength requirements of the shuttering element.

Engagement formations for engaging together a series of shuttering elements 10 are defined along opposite side edges of the shuttering element 10, the engagement formations permitting engagement of a plurality of shuttering elements in a configuration in which the shuttering surfaces 16 can form an extended continuous planar shuttering surface.

The engagement formations include profiled hook-like tongue formations 20, extending from the sides defined by walls 14.2 and 14.3 of the shuttering element 10 on the operative front side thereof, and similarly profiled tongue formations 22 projecting from the sides defined by walls 14.1 and 14.4 of the shuttering element 10 on the operative rear side thereof. The engagement formations further include recess formations 24 formed within the front face of the shuttering wall 12 along the sides defined by the walls 14.1 and 14.4, the said recess formations being formed to be releasably engaged by tongue formations 22 of adjacent shuttering elements when engaged to one another to form an extended shuttering surface. The tongue formations 22 are particularly disposed and formed to engage the operative rear edge of the side walls 14.2 and 14.3 of the shuttering element 10 so that both the operative front and rear sides of engaged shuttering elements are held together by means of the engagement formations as described above. The mode of engagement between adjacent panels is illustrated in more detail in FIG. 6 of the drawings, the secure location of engaged shuttering elements 10 being clearly illustrated therein.

Figure 6:
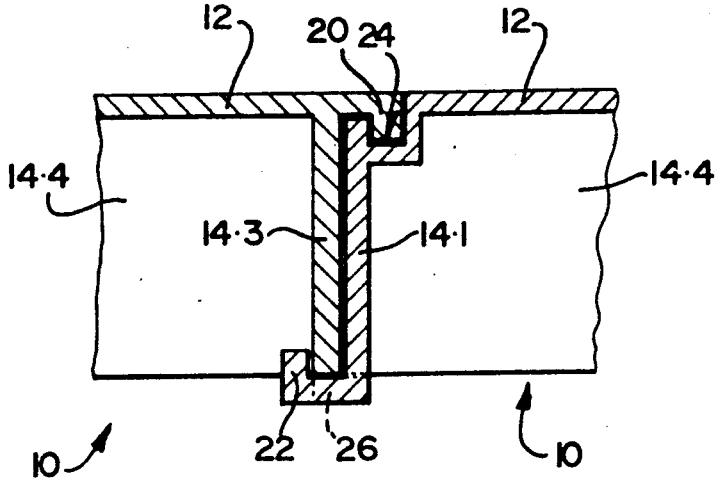
FIG. 6 shows a detailed cross-sectional view of engaged parts of two shuttering elements of FIG. 1.

The shuttering element 10 further defines locking formations for locking engaged shuttering elements in their engaged configuration, the locking formations being in the form of lips forming clipping formations 26 which project from the side walls 14.2 and 14.3 of the shuttering element 10 on the operative rear side thereof, as is clearly illustrated in FIGS. 2 to 5 of the drawings. With shuttering elements 10 engaged in their configuration as shown in FIG. 6, the clipping formation 26 of one shuttering element can clip over the operative rear edge of the side wall 14 of the adjacent shuttering element, thereby inhibiting displacement of adjacent shuttering elements in a direction transverse to the plane defined by their shuttering walls 12, thus inhibiting the required relative displacement of adjacent shuttering elements that will permit disengagement thereof. Adjacent shuttering elements can thus be securely engaged with one another and held in engagement until the clipping formations are released, which will require a manual force to be exerted thereon, without which disengagement of engaged shuttering elements 10 will thus not be possible. The operation of the clipping formations 26 is permitted by the inherent resilience of the material used for the shuttering panel 10.

Figure 9:
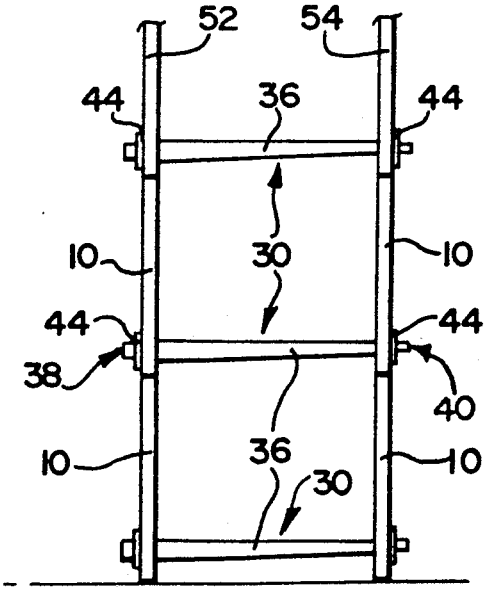
FIG. 9 shows an end view of a part of a shuttering structure constructed by means of shuttering elements in accordance with the invention.

It is therefore considered possible to engage a plurality of shuttering elements with one another and hold them in a locked configuration, it thus being possible to pre-assemble a complete shuttering wall of a shuttering structure, which can then be erected on site in an opposing configuration with an opposing wall of a shuttering structure, between which concrete can then be poured for the construction of walls, other building formations, or the like. A typical opposing configuration of such shuttering walls formed of shuttering elements 10 is clearly illustrated in FIG. 9 of the drawings.

In order to hold opposing shuttering walls in their required spaced apart configuration, provision is made for link rods that can link opposing walls to one another, a typical link rod being generally indicated by the reference number 30 in FIG. 7. In order to accommodate link rods 30, each shuttering element 10 defines locating formations for such link rods, the typical configuration of suitable locating formations only being illustrated on the sides of the shuttering element 10 defined by the side walls 14.2 and 14.4. Both these side walls define recess formations 32 across the width thereof, extending from the front face to the rear side of the shuttering element 10, the tongue formations 22 being suitably formed so that a receiving aperture 34 is defined between the side wall 14.4 and the tongue formations 22.

With shuttering elements engaged and locked to one another as described above, the two opposing recess formations 32 defined within opposing side walls 14.2 and 14.4 of adjacent shuttering elements 10 will define a continuous circular passage formed to accommodate a link rod 30.

Figure 8A:
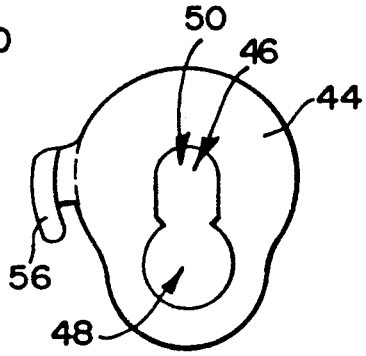
FIGS. 8A and 8B show a plan view and a front view respectively of a head formation for use with the rod element of FIG. 7.
Figure 8B:
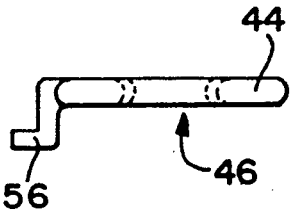

A typical link rod 30 includes an elongate rod element 36 that defines a circular cross-sectional profile and that tapers from the end 38 thereof towards the end 40. Peripheral recess formations 42 are defined near opposite ends thereof, these recess formations 42 being releasably engageable by head formations 44, a typical head formation being illustrated in FIGS. 8*a* and 8*b* of the drawings.

The head formation is in the form of a planar element defining a key hole aperture 46 therein, this key hole aperture 46 being formed to permit the aperture part 48 to fit over the opposite ends of the rod element 36 until in register with a recess formation 42, from where it can be linearly displaced so that the aperture portion 50 can be engaged within the particular recess formation.

In order to locate the spacing between two opposing shuttering walls made up of shuttering elements 10, a rod element 36 can thus pass through opposing apertures in the shuttering walls with opposite end regions of the rod element 36 extending beyond the operative outer sides of the shuttering walls. Two head formations 44 can then be located with respect to the rod element 36 and these can then bear against the shuttering elements 10 to thereby determine and secure the spacing between the opposing shuttering walls. This is clearly illustrated in FIG. 9 of the drawings which shows a part of a shuttering structure which is made up of two shuttering walls, 52 and 54 respectively, the rod element 36 being shown therein in the operative configuration as well as the head formations 44.

It will also be appreciated that the head formations can be easily released by merely displacing them into position in which the aperture portions 48 are aligned with ends of the rod element 36, which will permit their removal and, as such, the removal of rod element 36 from a structure constructed between two opposing shuttering walls. This aspect will be described in more detail hereafter.

Figure 1:
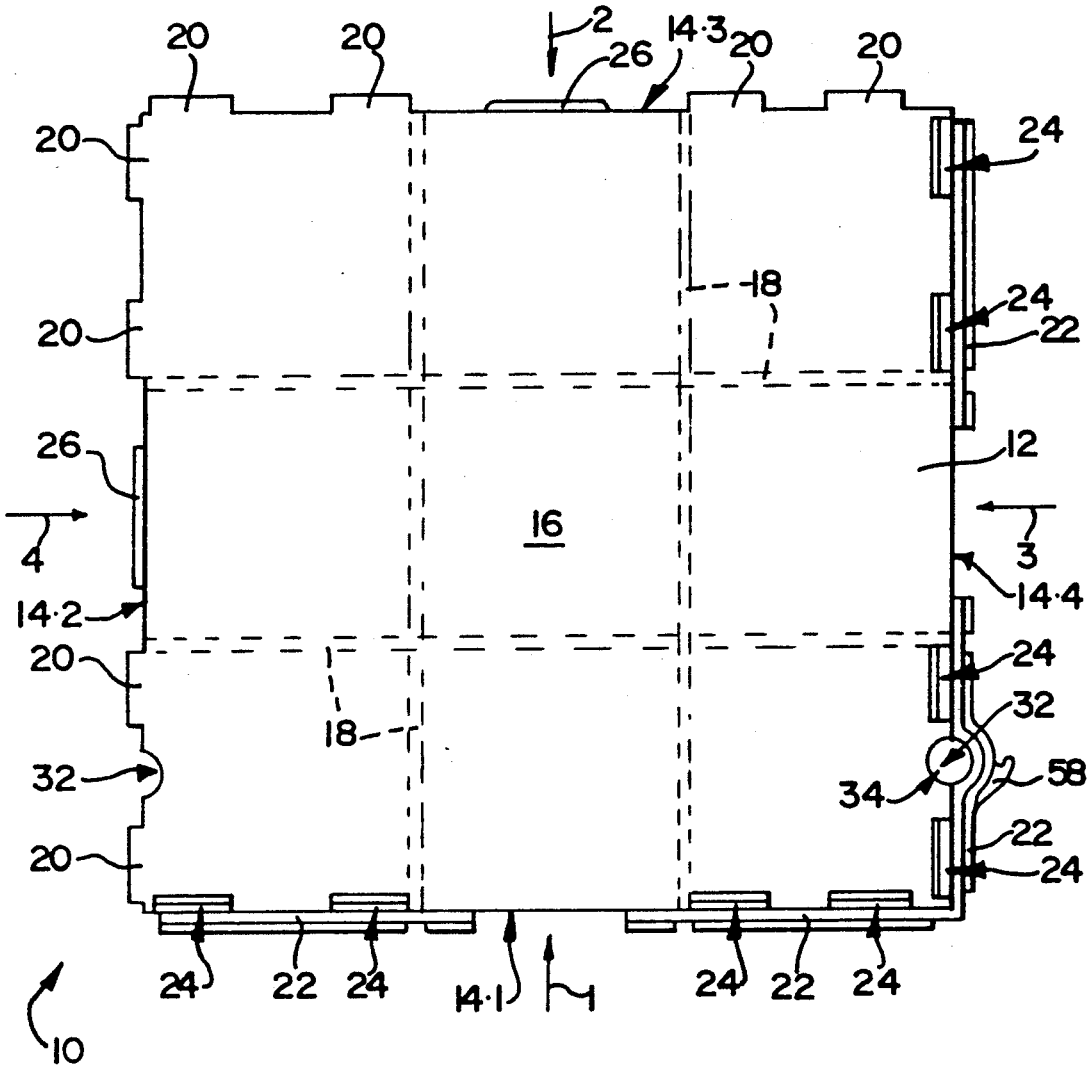
FIG. 1 shows an elevational front view of a shuttering element, in accordance with the invention.
Figure 2:
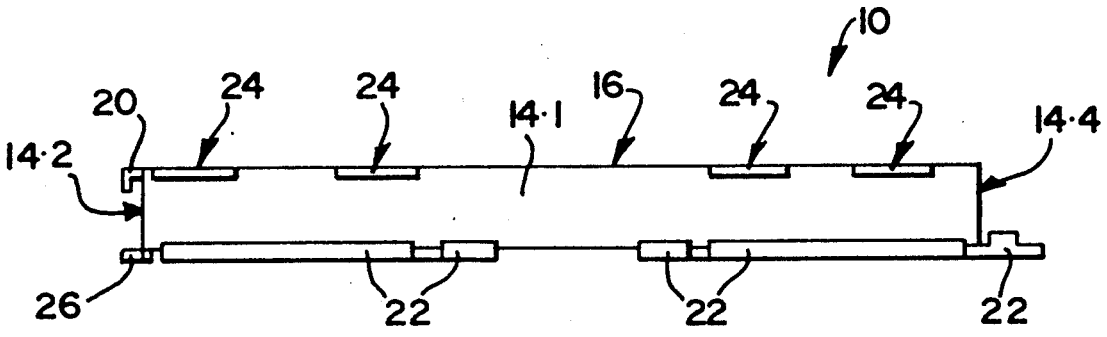
FIG. 2 shows a side view of the shuttering element of FIG. 1, as seen from the direction of arrow 1.
Figure 3:
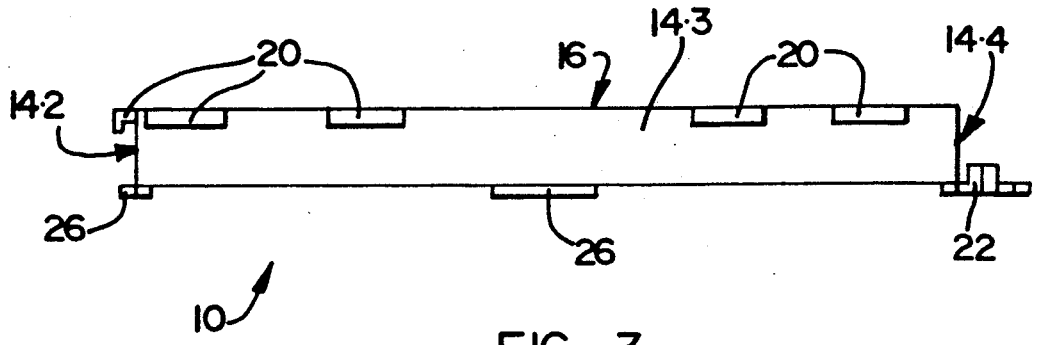
FIG. 3 shows a side view of the shuttering element of FIG. 1, as seen from the direction of arrow 2.
Figure 4:
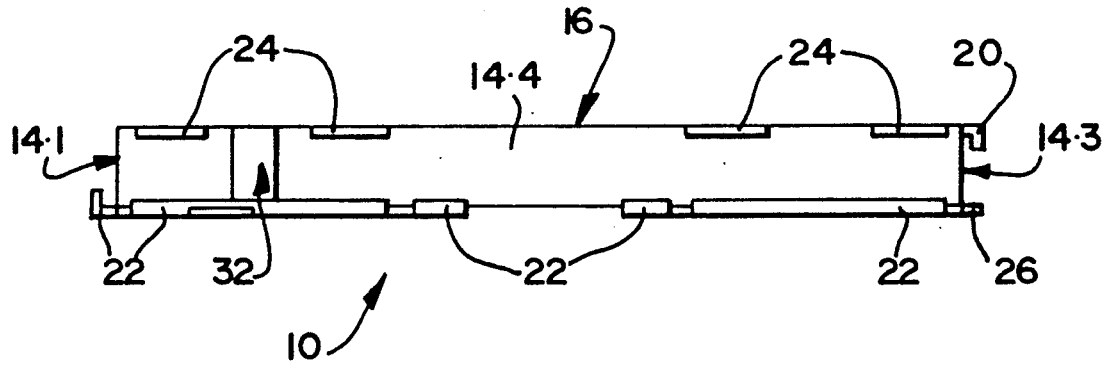
FIG. 4 shows a side view of the shuttering element of FIG. 1, as seen from the direction of arrow 3.
Figure 5:
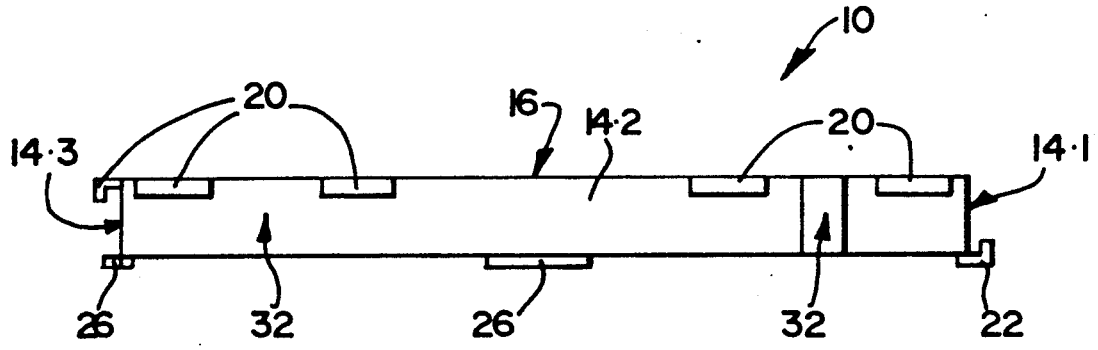
FIG. 5 shows a side view of the shuttering element of FIG. 1, as seen from the direction of arrow 4.

The head formation 44 further defines an off-set lug formation 56 which, through suitable rotation of the head formation 44, can engage a complementary locating formation 58 projecting from the side of a shuttering panel as is clearly illustrated in FIG. 1 of the drawings, such engagement ensuring simultaneously that two spaced apart shuttering walls will be held in their required spaced apart configuration and not only between opposite head formations 44, i.e. the position of shuttering elements 10 will be effectively fixed with respect to a link rod 30 through this engagement. Clearly engagement between the lug formation 56 of a head formation 44 and the complementary formation 58, projecting from a shuttering element 10, can be affected through suitable rotation of the head formation 44, once located on a rod element 36 of a link rod, and disengagement can be affected in a reverse mode.

It is anticipated that the link rods 30 may also be of a synthetic plastics material and, once again, it is anticipated that ABS and nylon may be particularly suitable. Because of the strength requirements of these link rods 30, nylon is in fact considered more suitable, particularly because of its tensile strength qualities.

It will be appreciated that the sides of the shuttering element 10 defined by side walls 14.1 and 14.3 may also be provided with similar locating formations for link rods whereas provision may also be made for two link rods per side wall 14.

It is further anticipated that the exact configuration of link rods 30 is greatly variable, it being important that link rods 30 are formed so that they can be easily assembled and particularly released, after the forming of walls between shuttering structures formed of shuttering elements 10.

It is suggested that the link rods 30 may be removable after the formation of walls, utilising shuttering structures formed of shuttering elements 10, and for this purpose, the rod element 36 of link rods 30 are tapered as shown. This tapering configuration will clearly facilitate the release of link rods from a wall formed and any remaining holes can thereafter be simply filled with concrete or another filler material. By providing both ends of link rods with similar peripheral recesses 42, it is also envisaged that projecting ends of link rods can merely be severed from the remaining part thereof after the removal of shuttering, which can simply be done by using a hot flame, or the like and, in this way, it will not be required to fill any holes.

It is already known to utilise shuttering for the construction of walls of building structures and other structures, by casting such walls, a settable material such as concrete being typically used for this purpose. The Applicant believes that the versatility and size of the shuttering elements 10 will greatly facilitate the construction of shuttering structures, the shuttering elements clearly being very light while, with the use of the link rods 30, will be able to perform the functions of the shuttering structure. By providing different special purpose shuttering members that can co-operate with shuttering elements 10, provision can be made for corner constructions, wall end constructions, wall openings for doors and windows, and the like, it being anticipated that many different auxiliary shuttering members may be provided and designed for this purpose. Provision may also be made for electrical wiring, plug boxes, plumbing fittings, and the like.

It will thus be possible to provide for a complete shuttering structure that can define an entire building construction to be constructed, whereafter the complete building structure can be formed by pouring concrete or another settable material into the shuttering structure and allowing it to set and cure.

As mentioned above, it is particularly anticipated that complete wall sections of a shuttering structure can be pre-assembled, whereafter these shuttering sections can be erected on site and be engaged together in the manner described above or via special purpose members, where corner constructions or other special formations are required. It will be appreciated that shuttering structures will be constructed by first erecting all the inner walls of a shuttering structure. Disassembly of the shuttering structure will take place by firstly providing for the release of opposing shuttering elements by removing the link rods, which will immediately permit the removal of the inner and outer walls of the shuttering structure.

A method of building construction utilising shuttering panels as defined above is anticipated to be particularly suitable for constructing low cost housing, the shuttering elements permitting complete shuttering structures to be erected in very short time and complete building constructions to be cast in single operations, which will thereafter merely require setting and curing of settable materials before it will be possible to proceed with the construction of walls and whatever else may be required. In order to reinforce walls formed, a reinforcing mesh, reinforcing members, or the like, may clearly be inserted into the space defined between opposing shuttering walls of a shuttering structure, it being particularly anticipated that special reinforcing means or members may be provided for this purpose. The link rods 30 can be used to suitably locate the reinforcing.

It is also anticipated that shuttering elements can be provided in different modular sizes and shapes to further enhance the versatility thereof and also permitting shuttering structures to be constructed to exact specifications.

One other addition anticipated provides for a hole to be defined within end regions of the rod elements 30, which can serve to locate and hold reinforcing U-sections (not shown). Shuttering structures can in this way be considerably reinforced. Clearly, the holes can also serve as holding or locating means for many other applications associated with the method of building construction envisaged by the Applicant. Alternative means can also be provided as part of the rod elements 30 and/or head formations 44.

Building structures that can be constructed by utilising shuttering elements, in accordance with the invention can include homes and like buildings. The shuttering can then also serve as a soffit for roof construction. By profiling the exposed surfaces of the shuttering elements, different finishes can be provided for.

I claim:

1. A shuttering element, comprising: a rigid synthetic plastic rectangular body having a planar shuttering wall having a forward face and a rearward face and an outer perimeter, four side walls extending rearwardly from the outer perimeter of the forward face of said shuttering wall, and having rearward edges;

two adjacent first side walls being provided at their rearward edges with tongue formations extending outwardly, said tongue formations being generally J-shaped and being sized to receive a rearward edge of a side wall of a shuttering element therein; said planar shuttering wall being provided in its forward face with recesses along the outer perimeter thereof adjacent said two first side walls;

said planar shuttering wall being provided in its forward face with resilient hook formations along the outer perimeter thereof adjacent the two adjacent other side walls, said hook formations being sized to fit into and engage said recesses;

whereby said shuttering element may be secured to other shuttering elements having similarly sized and located side walls, tongue formations, recesses and hook formations by the engagement of the tongue formations of the two first side walls of the shuttering element with the rearward edges of the two other side walls of the other shuttering elements, and the engagement of the tongue formations of the two first side walls of the other shuttering elements with the rearward edges of the two other side walls of the shuttering element, and by the engagement of the hook formations of the shuttering element with the recesses of the other shuttering elements, and the engagement of the hook formations of the other shuttering elements with the recesses of the shuttering element.

2. A shuttering element as claimed in claim 1, further comprising:

clipping support formations extending outwardly from the rearward edge of said other side walls for receiving the rearward edges of the first side walls of other shuttering elements.

3. A shuttering element as claimed in claim 2, further comprising reinforcing ribs formed in the rearward face of said shuttering wall.

4. A shuttering element as claimed in claim 3, wherein said reinforcing ribs comprise four perpendicularly intersecting ribs forming a lattice.

5. A shuttering element as claimed in claim 3, further comprising an aperture for receiving a link rod therein.

6. A shuttering mold comprising:

a first mold wall comprising a plurality of shuttering elements secured together;

a second mold wall comprising a plurality of shuttering elements secured together;

said shuttering elements comprising a rigid synthetic plastic rectangular body having a planar shuttering wall having a forward face and a rearward face and an outer perimeter, said rearward face being provided with a lattice of reinforcing ribs, four side walls extending rearwardly from the outer perimeter of the forward face of said shuttering wall, and having rearward edges;

two adjacent first side walls being provided at their rearward edges with tongue formations extending outwardly, said tongue formations being generally J-shaped and being sized to receive a rearward edge of a side wall of a shuttering element therein; said planar shuttering wall being provided in its forward face with recesses along the outer perimeter thereof adjacent said two first side walls;

said planar shuttering wall being provided in its forward face with resilient hook formations along the outer perimeter thereof adjacent the two adjacent other side walls, said hook formations being sized to fit into and engage said recesses;

clipping support formations extending outwardly from the rearward edge of said other side walls for receiving the rearward edges of the first side walls of other shuttering elements;

an aperture for receiving a link rod therein;

whereby said shuttering element may be secured to other shuttering elements having similarly sized and located side walls, tongue formations, recesses and hook formations to form said mold walls by the engagement of the tongue formations of the two first side walls of a shuttering element with the rearward edges of the two other side walls of other shuttering elements, and the engagement of the tongue formations of the two first side walls of the other shuttering elements with the rearward edges of the two other side walls of the shuttering element, and by the engagement of the hook formations of the shuttering element with the recesses of the other shuttering elements, and the engagement of the hook formations of the other shuttering elements with the recesses of the shuttering element, and by the engagement of the clipping support formations with the rearward edges of the side walls of adjacent other shuttering elements;

said first and second mold walls being arranged with said forward faces of said planar shuttering walls facing each other in a spaced apart relationship;

said two mold walls held in spaced apart relationship from each other by a plurality of link rods, said link rods extending through said link rod receiving apertures and having two ends and recessed sections located axially inwardly from the ends of said link rods; and planar head formations having keyhole shaped apertures therein, said key hole apertures having a larger diameter end and a smaller diameter end, said larger diameter end being sized to fit over said link rod end, and said smaller diameter end being sized to engage said recessed sections of said link rods, said head formations being adapted to removably lock said link rods in position relative to said shuttering elements.

7. A shuttering mold as claimed in claim 6 wherein said head formations have a hook shaped lug extending axially therefrom, and wherein said shuttering elements have formed thereon a complementary generally hook shaped locating formation located on the rearward face of said shuttering elements adjacent said link rod receiving aperture for engagement with said lug.

* * * * *